US012747088B2

(12) United States Patent
Sollie et al.

(10) Patent No.: US 12,747,088 B2
(45) **Date of Patent: *Sep. 29, 2026**

(54) BOX DEFINING WALLS WITH INSULATION CAVITIES

(71) Applicant: Pratt Retail Specialties, LLC, Brookhaven, GA (US)

(72) Inventors: Greg Sollie, Sharpsburg, GA (US); Jamie Waltermire, Peachtree City, GA (US); Shifeng Chen, Newport News, VA (US)

(73) Assignee: Pratt Retail Specialties, LLC, Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/252,342

(22) Filed: Jun. 27, 2025

(65) Prior Publication Data

US 2025/0326562 A1 Oct. 23, 2025

Related U.S. Application Data

(60) Continuation of application No. 18/517,626, filed on Nov. 22, 2023, now Pat. No. 12,344,454, which is a (Continued)

(51) Int. Cl.
*B65D 81/38* (2006.01)

(52) U.S. Cl.
CPC ..... *B65D 81/3848* (2013.01)

(58) Field of Classification Search
CPC .. B65D 81/3853; B65D 81/3897; B65D 5/56; B65D 81/3858; B65D 81/3862; B65D 65/466; B65D 81/3848
USPC ..... 229/103.11, 122.32, 167, 168; 220/592.25, 592.2; 312/259; 428/121, 428/172
See application file for complete search history.

(56) References Cited

U.S. PATENT DOCUMENTS 1,896,076 A 2/1933 Frostad
1,993,394 A 3/1935 Bangs et al.
(Continued)

FOREIGN PATENT DOCUMENTS

AU 2023285920 B2 8/2025
AU 2024216412 B2 9/2025
(Continued)

OTHER PUBLICATIONS

US 12,656,050 B2, 06/2026, Waltermire et al. (withdrawn)
(Continued)

*Primary Examiner* — Christopher R Demeree
(74) *Attorney, Agent, or Firm* — Smith, Gambrell & Russell, LLP

(57) ABSTRACT

A method of assembling a box from a blank and an insulator pad includes obtaining a blank comprising an outer side panel comprising an outer fold line, a connecting strip joined to the outer side panel by a fold line, and an inner side panel connected to the connecting strip by a fold line; obtaining an insulator pad comprising an angled cut defining an edge; folding the inner side panel such that the inner side panel faces the outer side panel; and positioning the insulator pad between the outer side panel and the inner side panel such that the edge of the insulator pad is positioned at the inner fold line.

18 Claims, 9 Drawing Sheets

Related U.S. Application Data continuation of application No. 17/679,772, filed on Feb. 24, 2022, now Pat. No. 11,919,699, which is a continuation of application No. 17/078,891, filed on Oct. 23, 2020, now Pat. No. 11,325,772, which is a division of application No. 16/401,603, filed on May 2, 2019, now Pat. No. 10,882,684.

(56) References Cited

U.S. PATENT DOCUMENTS

| | | | | |
|---|---|---|---|---|
| 2,023,682 | A | 12/1935 | Higginbottom | |
| 2,532,778 | A | 12/1950 | Louis | |
| 2,758,519 | A | 8/1956 | Steen | |
| 2,838,224 | A | 6/1958 | Steen | |
| 2,952,396 | A | 9/1960 | Steen | |
| 3,055,575 | A | 9/1962 | Gerard | |
| 3,149,771 | A | 9/1964 | Pearl | |
| 3,344,973 | A | 10/1967 | Studen | |
| 3,346,173 | A | 10/1967 | Smith et al. | |
| 3,451,316 | A | 6/1969 | Bagnall | |
| 3,504,475 | A | 4/1970 | Dickard et al. | |
| 3,719,318 | A | 3/1973 | Moran | |
| 3,857,329 | A | 12/1974 | Lehmacher et al. | |
| 4,211,091 | A | 7/1980 | Campbell | |
| 4,362,526 | A | 12/1982 | Wilson | |
| 4,510,620 | A | 4/1985 | Langen et al. | |
| 4,584,201 | A | 4/1986 | Boston | |
| 4,686,814 | A | 8/1987 | Yanase | |
| 4,755,064 | A | 7/1988 | Weber | |
| 4,790,804 | A | 12/1988 | Gotou et al. | |
| 4,979,933 | A | 12/1990 | Runge | |
| 5,044,776 | A | 9/1991 | Schramer et al. | |
| 5,289,906 | A | 3/1994 | Guidi | |
| 5,685,129 | A | 11/1997 | Baker | |
| 6,146,016 | A | 11/2000 | Mucci et al. | |
| 6,513,974 | B2 | 2/2003 | Malone et al. | |
| 6,517,243 | B2 | 2/2003 | Huffer et al. | |
| 7,322,162 | B2 | 1/2008 | Gifford | |
| 8,016,090 | B2 | 9/2011 | Mccoy et al. | |
| 8,651,593 | B2 * | 2/2014 | Bezich | B65D 5/68 312/259 |
| 9,211,970 | B2 | 12/2015 | Hubbard, Jr. et al. | |
| 9,499,309 | B2 | 11/2016 | Zerfas et al. | |
| 9,505,516 | B2 | 11/2016 | Hubbard, Jr. et al. | |
| 9,533,790 | B2 | 1/2017 | Williams | |
| 9,635,916 | B2 * | 5/2017 | Bezich | B65D 25/2897 |
| D861,338 | S | 10/2019 | Seiders et al. | |
| 11,560,266 | B1 | 1/2023 | Kumar | |
| D1,039,273 | S | 8/2024 | Rogers et al. | |
| 12,171,377 | B2 | 12/2024 | Franklin | |
| 12,344,454 | B2 | 7/2025 | Sollie et al. | |
| 12,371,221 | B2 | 7/2025 | Sollie et al. | |
| 12,419,399 | B2 | 9/2025 | Larson et al. | |
| D1,097,567 | S | 10/2025 | Kim | |
| D1,099,531 | S | 10/2025 | Seiders et al. | |
| 12,504,220 | B2 | 12/2025 | Waltermire et al. | |
| 12,515,870 | B2 | 1/2026 | Waltermire et al. | |
| 12,522,420 | B2 | 1/2026 | Sollie et al. | |
| 12,528,637 | B2 | 1/2026 | Sollie et al. | |
| 12,565,371 | B2 | 3/2026 | Collison et al. | |
| 2002/0094139 | A1 | 7/2002 | Buchanan et al. | |
| 2004/0109617 | A1 | 6/2004 | Winiecki | |
| 2006/0037815 | A1 | 2/2006 | Schabel, Jr. | |
| 2007/0274613 | A1 | 11/2007 | Pruchnicki et al. | |
| 2011/0142373 | A1 | 6/2011 | Kong | |
| 2014/0319018 | A1 * | 10/2014 | Collison | B65D 81/3858 428/34.3 |
| 2017/0057702 | A1 | 3/2017 | Simhaee et al. | |
| 2017/0127777 | A1 | 5/2017 | Cohen | |
| 2018/0229917 | A1 * | 8/2018 | Jobe | B32B 9/02 |
| 2019/0367209 | A1 * | 12/2019 | Jobe | B65D 81/3834 |
| 2020/0245735 | A1 | 8/2020 | Sitnikova | |
| 2021/0300665 | A1 | 9/2021 | Melchor | |
| 2022/0002070 | A1 | 1/2022 | Moghaddas et al. | |
| 2024/0083659 | A1 | 3/2024 | Sollie et al. | |
| 2025/0368426 | A1 | 12/2025 | Sollie et al. | |
| 2026/0008585 | A1 | 1/2026 | Sollie et al. | |
| 2026/0138808 | A1 | 5/2026 | Sollie et al. | |
| 2026/0138809 | A1 | 5/2026 | Sollie et al. | |

FOREIGN PATENT DOCUMENTS

| | | | | |
|---|---|---|---|---|
| AU | 2023203006 | B2 | 11/2025 | |
| AU | 2024204391 | B2 | 12/2025 | |
| CA | 3176052 | | 9/2025 | |
| CN | 101605652 | | 12/2009 | |
| EP | 2363544 | | 9/2011 | |
| GB | 197998 | A | 5/1923 | |
| GB | 2400096 | A * | 10/2004 | B65D 81/386 |
| JP | 2524288 | B2 | 8/1996 | |
| JP | 2008050724 | | 3/2008 | |
| KR | 20050050848 | | 6/2005 | |
| WO | 2006091031 | | 8/2006 | |
| WO | 2009106974 | | 9/2009 | |
| WO | 2018112585 | | 6/2018 | |

OTHER PUBLICATIONS

US 12,668,412 B2, 06/2026, Waltermire et al. (withdrawn)
US 12,709,453 B2, 08/2026, Waltermire et al. (withdrawn)
US 12,716,644 B2, 08/2026, Waltermire et al. (withdrawn)
Sollie, Greg; Requirement for Restriction/Election for U.S. Appl. No. 18/517,626, filed Nov. 22, 2023, mailed Jun. 13, 2024, 6 pgs.
Sollie, Greg; Non-Final Office Action for U.S. Appl. No. 18/517,626, filed Nov. 22, 2023, mailed Aug. 30, 2024, 159 pgs.
Sollie, Greg; Final Office Action for U.S. Appl. No. 18/517,626, filed Nov. 22, 2023, mailed Dec. 12, 2024, 16 pgs.
Sollie, Greg; Notice of Allowance for U.S. Appl. No. 18/517,626, filed Nov. 22, 2023, mailed Feb. 28, 2025, 10 pgs.
Waltermire, Jamie; Non-Final Office Action for U.S. Appl. No. 18/115,791, filed Mar. 1, 2023, mailed Nov. 28, 2025, 27 pgs.
Waltermire, Jamie; Advisory Action for U.S. Appl. No. 17/173,293, filed Feb. 11, 2021, mailed Oct. 1, 2025, 3 pgs.
Waltermire, Jamie; Non-Final Office Action for U.S. Appl. No. 17/173,293, filed Feb. 11, 2021, mailed Dec. 5, 2025, 24 pgs.
Waltermire, Jamie; Corrected Notice of Allowance for U.S. Appl. No. 18/197,300, filed May 15, 2023, mailed Nov. 26, 2025, 8 pgs.
Waltermire, Jamie; Notice of Allowance for U.S. Appl. No. 19/188,779, filed Apr. 24, 2025, mailed Nov. 17, 2025, 13 pgs.
Sollie, Greg; Requirement for Restriction/Election for U.S. Appl. No. 19/328,837, filed Sep. 15, 2025, mailed Oct. 30, 2025, 6 pgs.
Sollie, Greg; Notice of Allowance for U.S. Appl. No. 18/974,426, filed Dec. 9, 2024, mailed Sep. 26, 2025, 12 pgs.
Chen, Greg; Notice of Allowance for U.S. Appl. No. 19/185,469, filed Apr. 22, 2025, mailed Oct. 2, 2025, 10 pgs.
Waltermire, Jamie; Examination Report for Australian Patent Application No. 2024227354, filed Nov. 8, 2018, mailed Nov. 28, 2025, 4 pgs.
Pratt Retail Pty Ltd; Office Action for Chinese Patent Application No. 202311045972.8, filed Nov. 7, 2017, mailed Nov. 29, 2025, 6 pgs.
Collison, Alan B.; Notice of Allowance for U.S. Appl. No. 18/612,835, filed Mar. 21, 2024, mailed Oct. 28, 2025, 7 pgs.
Waltermire, Jamie; Final Office Action for U.S. Appl. No. 18/385,726, filed Oct. 31, 2023, mailed Dec. 11, 2025, 20 pgs.
https://www.acme-hardesty.com/producUsodium-coco-sulfate-scs-95/ (Year: 2014).
Anagnostopoulos, John; Non-Final Office Action for U.S. Appl. No. 19/056,573, filed Feb. 18, 2025, mailed Dec. 23, 2025, 26 pgs.
Sollie, Greg; Non-Final Office Action for U.S. Appl. No. 19/328,837, filed Sep. 15, 2025, mailed Jan. 23, 2026, 15 pgs.
Waltermire, Jamie; Notice of Allowance for U.S. Appl. No. 18/734,865, filed Jun. 5, 2024, mailed Feb. 10, 2026, 22 pgs.
Waltermire, Jamie; Notice of Allowance for U.S. Appl. No. 17/538,795, filed Nov. 30, 2021, mailed Feb. 25, 2026, 27 pgs.
Waltermire, Jamie; Examination Report for Australian Patent Application No. 2024203770, filed Nov. 8, 2018, mailed Feb. 25, 2026, 4 pgs.

(56) References Cited

OTHER PUBLICATIONS

Waltermire, Jamie; Notice of Allowance for U.S. Appl. No. 18/385,726, filed Oct. 31, 2023, mailed Mar. 20, 2026, 14 pgs.
Waltermire, Jamie; Final Office Action for U.S. Appl. No. 17/173,293, filed Feb. 11, 2021, mailed Mar. 25, 2026, 23 pgs.
Waltermire, Jamie; Final Office Action for U.S. Appl. No. 18/115,791, filed Mar. 1, 2023, mailed Mar. 26, 2026, 26 pgs.
Sollie, Greg; Non-Final Office Action for U.S. Appl. No. 19/450,853, filed Jan. 16, 2026, mailed Apr. 3, 2026, 9 pgs.
Sollie, Greg; Restriction Requirement for U.S. Appl. No. 19/446,284, filed Jan. 12, 2026, mailed Apr. 9, 2026, 5 pgs.
Waltermire, Jamie; Non-Final Office Action for U.S. Appl. No. 18/747,098, filed Jun. 18, 2024, mailed Apr. 22, 2026, 215 pgs.
Waltermire, Jamie; Examination Report for Australian Patent Application No. 2024208808, filed Nov. 8, 2018, mailed Apr. 28, 2026, 5 pgs.
Sollie, Greg; Notice of Allowance for U.S. Appl. No. 19/328,837, filed Sep. 15, 2025, mailed May 11, 2026, 17 ogs.
Pratt Retail Pty Ltd; Search Report for Chinese Patent Application No. 202311045972.8, filed Nov. 7, 2017, mailed Mar. 27, 2026, 6 pgs.
Waltermire, Jamie; Examination Report for Australian Patent Application No. 2024205762, filed Nov. 8, 2018, mailed May 14, 2026, 10 pgs.
Waltermire, Jamie; Notice of Allowance for U.S. Appl. No. 18/734,865, filed Jun. 5, 2024, mailed May 22, 2026, 2 pgs.
MP Global Products, L.L.C.; Notice of Acceptance for Australian Patent Application No. 2024201654, filed Nov. 7, 2017, mailed Apr. 24, 2026, 3 pgs.
Pratt Retail Specialties, LLC; Examination Report for Australian Patent Application No. 2024205763, filed Nov. 8, 2018, mailed May 29, 2026, 7 pgs.
Waltermire, Jamie; Examination Report for Australian Patent Application No. 2024208808, filed Nov. 8, 2018, mailed Jun. 9, 2026, 8 pgs.
Waltermire, Jamie; Examination Report for Australian Patent Application No. 2025202153, filed Nov. 8, 2018, mailed Jun. 11, 2026, 4 pgs.
Waltermire, Jamie; Non-Final Office Action for U.S. Appl. No. 17/173,293, filed Feb. 11, 2021, mailed Jul. 1, 2026, 21 pgs.
Sollie, Greg; Non-Final Office Action for U.S. Appl. No. 19/446,284, filed Jan. 12, 2026, mailed Jan. 6, 2026, 27 pgs.
Waltermire, Jamie; Examination Report for Australian Patent Application No. 2025200280, filed Nov. 8, 2018, mailed Jul. 8, 2026, 4 pgs.
Waltermire, Jamie; Non-Final Office Action for U.S. Appl. No. 18/115,791, filed Mar. 1, 2023, mailed Jul. 16, 2026, 22 pgs.
Waltermire, Jamie; Notice of Acceptance for Australian Patent Application No. 2024227354, filed Nov. 8, 2018, mailed Jul. 10, 2026, 4 pgs.
Sollie, Greg; Final Office Action for U.S. Appl. No. 19/450,853, filed Jan. 16, 2026, mailed Jul. 22, 2026, 20 pgs.
Waltermire, Jamie; Examination Report for Australian Patent Application No. 2025213682, filed Nov. 8, 2018, mailed Jul. 23, 2026, 3 pgs.
Waltermire, Jamie; Examination Report for Australian Patent Application No. 2025213681, filed Nov. 8, 2018, mailed Jul. 22, 2026, 3 pgs.
Waltermire, Jamie; Examination Report for Australian Patent Application No. 2025213677, filed Nov. 8, 2018, mailed Jul. 21, 2026, 3 pgs.
Anagnostopoulos, John; Non-Final Office Action for U.S. Appl. No. 19/056,573, filed Feb. 18, 2025, mailed Jul. 27, 2026, 31 pgs.
Waltermire, Jamie; Notice of Acceptance for Australian Patent Application No. 2025202153, filed Nov. 8, 2018, mailed Jul. 29, 2026, 4 pgs.
Waltermire, Jamie; Non-Final Office Action for U.S. Appl. No. 19/190,395, filed Apr. 25, 2025, mailed Aug. 11, 2026, 45 pgs.
Waltermire, Jamie; Notice of Acceptance for Australian Patent Application No. 2024208808, filed Nov. 8, 2018, mailed Aug. 11, 2026, 4 pgs.

* cited by examiner

BOX DEFINING WALLS WITH INSULATION CAVITIES

REFERENCE TO RELATED APPLICATION

This application is a continuation of U.S. application Ser. No. 18/517,626, filed Nov. 22, 2023, which is a continuation of U.S. application Ser. No. 17/679,772, filed Feb. 24, 2022, which issued into U.S. Pat. No. 11,919,699 on Mar. 5, 2024, which is a continuation of U.S. application Ser. No. 17/078,891, filed Oct. 23, 2020, which issued into U.S. Pat. No. 11,325,772 on May 10, 2022, which is a divisional of U.S. application Ser. No. 16/401,603, filed May 2, 2019, which issued into U.S. Pat. No. 10,882,684 on Jan. 5, 2021, which are each hereby specifically incorporated by reference herein their entirety.

JOINT RESEARCH AGREEMENT

The subject matter disclosed was developed and the claimed invention was made by, or on behalf of, one or more parties to a joint research agreement between MP Global Products LLC of Norfolk, NE and Pratt Retail Specialties, LLC of Conyers, GA, that was in effect on or before the effective filing date of the claimed invention, and the claimed invention was made as a result of activities undertaken within the scope of the joint research agreement.

TECHNICAL FIELD

This disclosure relates to foldable boxes. More specifically, this disclosure relates to insulated foldable boxes.

BACKGROUND

Home delivery of food is becoming more common as the process becomes more efficient and costs go down. Delivery boxes may alternatively need to keep the food hot or cold enough to, for example, prevent bacterial growth, prevent melting or congealing of the food, or simply maintain the edibility, texture, and flavor of the food. Another consideration for the type of box to use is its impact on the environment, as it relates to the reusability and recyclability of the boxes. Polystyrene foam boxes are prevalent in the food-delivery industry because of their low cost, but they are not commonly recycled. Thus, they take up a disproportionate volume of landfill space.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a method of assembling a box from a blank and an insulator pad, the method comprising obtaining a blank comprising an outer side panel comprising an outer fold line, a connecting strip joined to the outer side panel by a fold line, and an inner side panel connected to the connecting strip by a fold line and defining a plane and comprising an inner fold line positioned parallel to the outer fold line of the outer side panel; obtaining an insulator pad comprising an angled cut defining an edge of the insulator pad that is angled relative to the plane of the inner side panel; folding the inner side panel such that the inner side panel faces the outer side panel; and positioning the insulator pad between the outer side panel and the inner side panel such that the edge of the insulator pad is positioned at the inner fold line.

Also disclosed is a method of assembling a box, the method comprising obtaining a blank comprising an outer side panel comprising an outer fold line, an outer bottom panel joined to the outer side panel by a fold line, a connecting strip joined to the outer side panel by a fold line, an inner side panel connected to the connecting strip by a fold line and defining a plane and comprising an inner fold line positioned parallel to the outer fold line of the outer side panel, and an inner bottom panel joined to the inner side panel by a fold line; obtaining a first insulator pad; folding the outer bottom panel such that the outer bottom panel is perpendicular to the outer side panel; folding the inner bottom panel such that the inner bottom panel faces the outer bottom panel; and positioning the first insulator pad between the outer bottom panel and the inner bottom panel.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
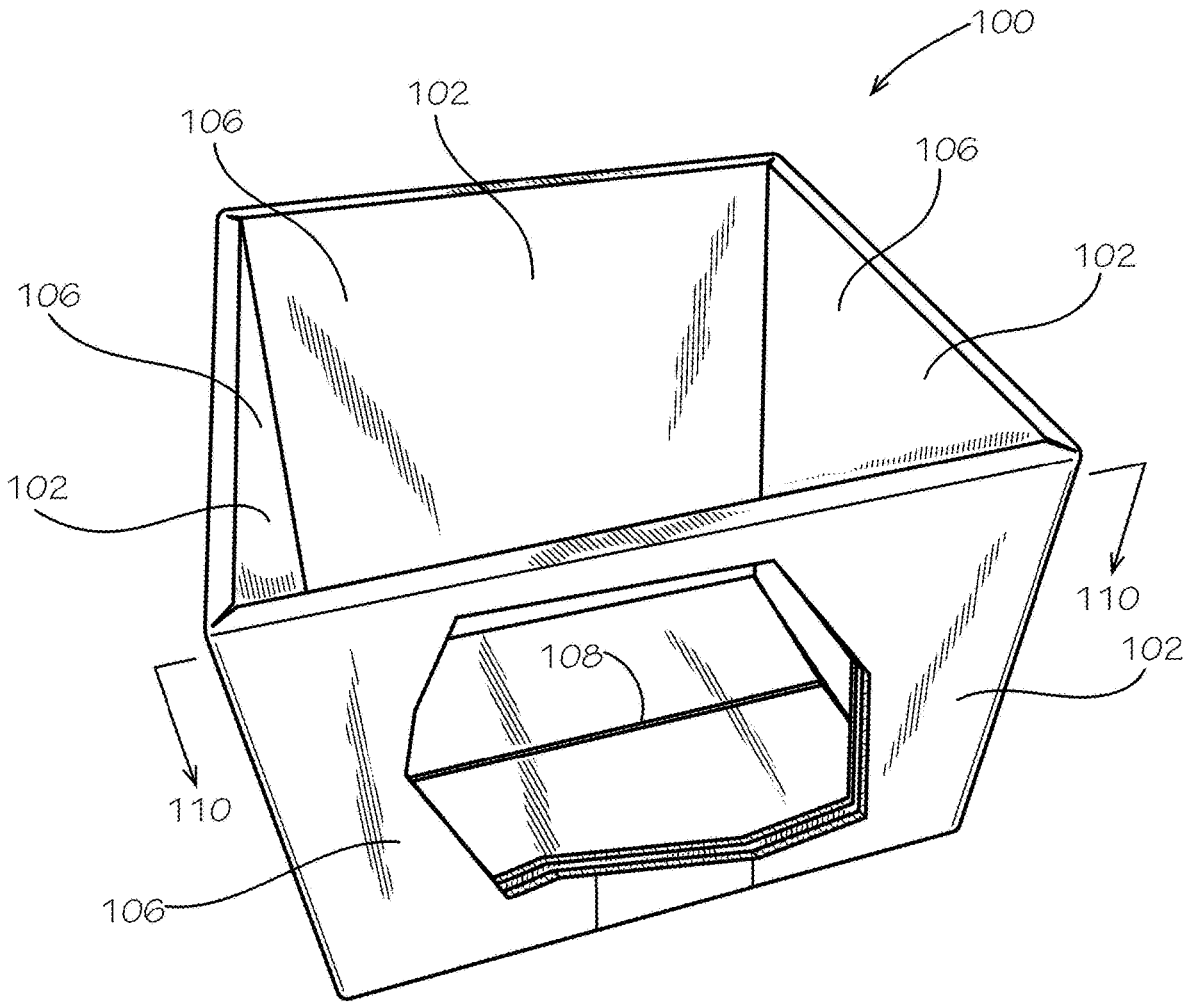
FIG. 1A shows a box comprising walls defining insulation cavities therein.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a box comprising walls that define insulation cavities and associated methods, systems, devices, and various apparatus. It would be understood by one of skill in the art that the disclosed box is described in but a few exemplary embodiments among many. No particular terminology or description should be considered limiting on the disclosure or the scope of any claims issuing therefrom.

For ease of understanding, the use of the directional terms herein, such as right, left, front, back, top, bottom, and the like can refer to the orientation shown and described in the corresponding figures, but these directional terms should not be considered limiting on the orientation or configuration required by the present disclosure. The use of ordinal terms herein, such as first, second, third, fourth, and the like can refer to elements associated with elements having matching ordinal numbers. For example, a first light bulb can be associated with a first light socket, a second light bulb can be associated with a second light socket, and so on. However, the use of matching ordinal numbers should not be considered limiting on the associations required by the present disclosure.

FIG. 1A shows in one exemplary aspect a box 100 comprising walls 102 defining insulation cavities 104 (shown in FIG. 1B) within each of the walls 102. The walls 102 can comprise a plurality of sides 106 and a bottom 108 of the box 100. The box 100 can comprise four or any other number of sides 106. The sides 106 and the bottom 108 can define an interior 110 of the box 100. The sides 106 and the bottom 108 can comprise the insulation cavities 104 when the box 100 is assembled in accordance with the present disclosure. Line 110-110 defines a cross-section, a perspective view of which is shown in FIG. 1B.

Figure 1B:
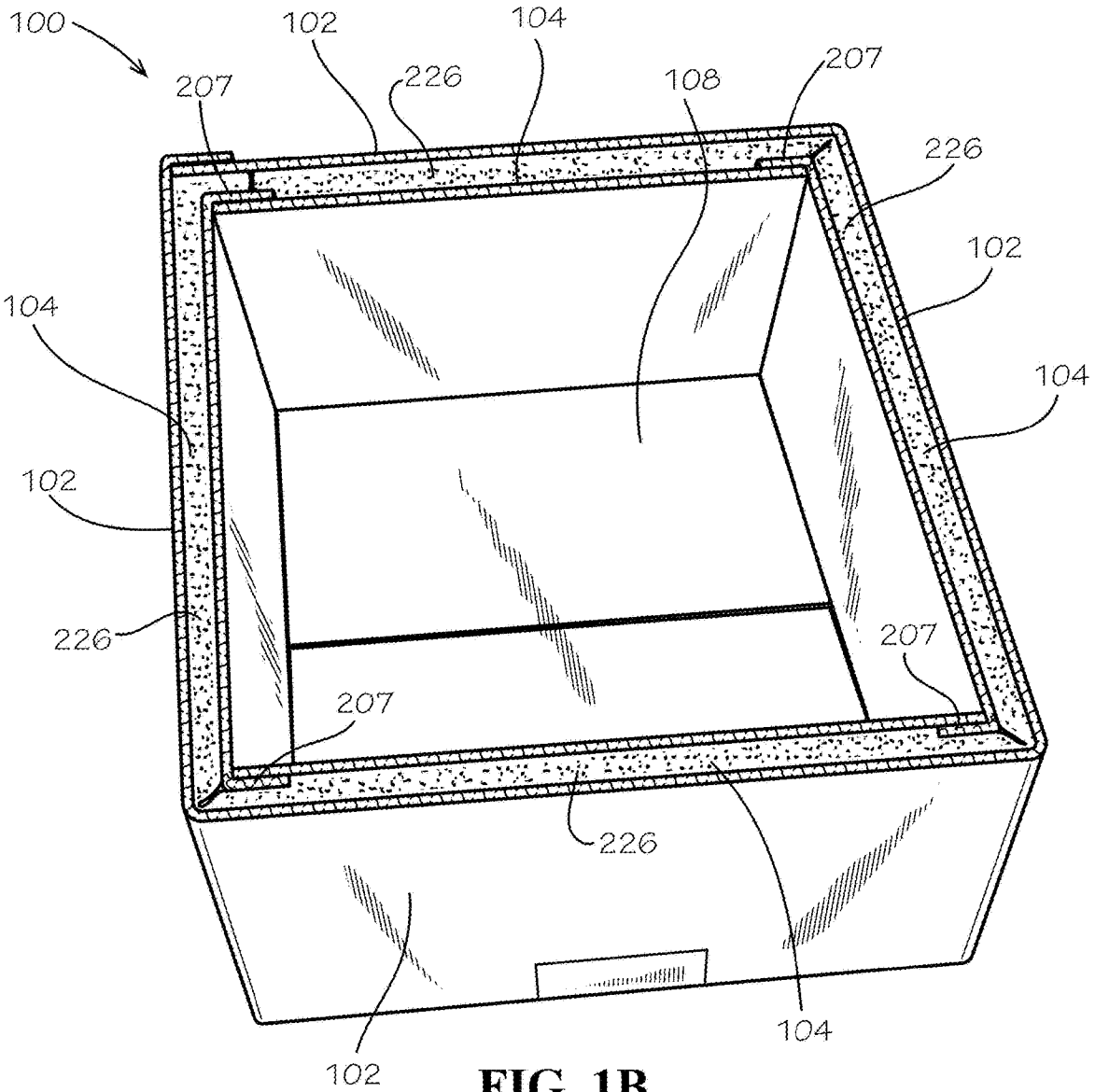
FIG. 1B shows a cross-section of the box of FIG. 1A taken along line 110-110 of FIG. 1A.

FIG. 1B is a cross-sectional view of the box 100 of FIG. 1A. The cross-sectional plane is defined by line 110-110. The insulation cavities 104 can be defined within each of the walls 102, the construction of the walls 102 being described more fully below. In the current aspect, the insulation cavities 104 are empty and filled with air. In other aspects, various insulators such as repulpable or recyclable insulator pads 226 (described below) can fill the cavities 104.

Figure 2:
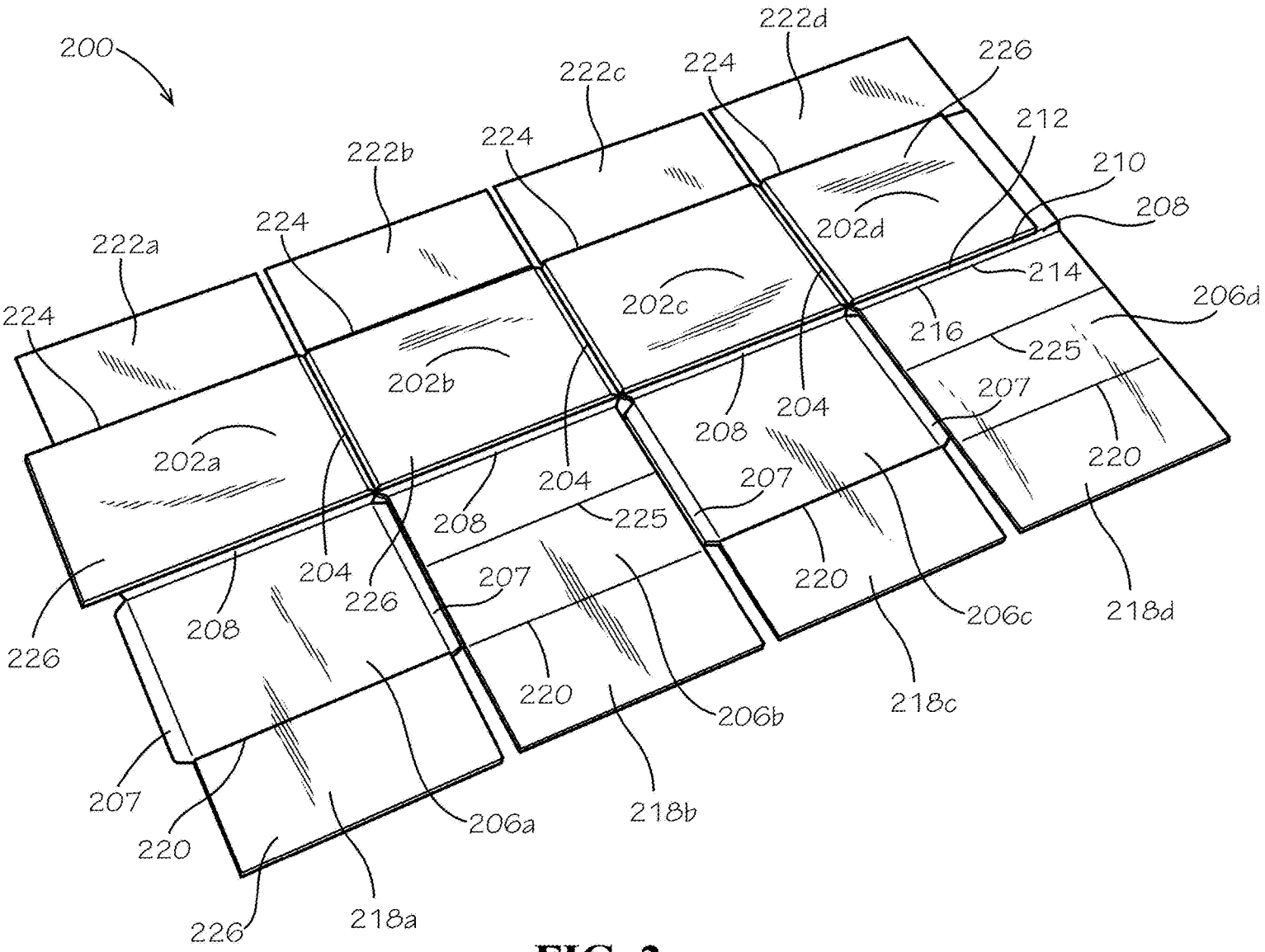
FIG. 2 shows a blank configured to form the box of FIG. 1.

FIG. 2 shows in one exemplary aspect a blank 200 configured to form the box 100 of FIG. 1. The blank 200 can comprise four outer side panels 202*a,b,c,d*, each connected to another by a parallel fold line 204. Each of four inner side panels 206*a,b,c,d* can be connected to one of the four outer side panels 202*a,b,c,d* by a connecting strip 208. Each connecting strip 208 can be connected to the respective outer side panel 202*a,b,c,d* by a fold line 210 along one edge 212 and be connected to respective the inner side panel 206*a,b,c,d* by a fold line 214 on an opposite edge 216. Each of a first and a third inner side panel 206*a,c* can comprise two tabs 207. Each of four inner bottom panels 218*a,b,c,d* can be connected to one of the four inner side panels 206*a,b,c,d* by a fold line 220. The blank can also comprise four outer bottom panels 222*a,b,c,d*, each connected to one of the four outer side panels 202*a,b,c,d* by a fold line 224. Additionally, in some aspects, the blank 200 for the box 100 can be dimensioned such that some of the inner side panels 206*a, b,c,d* cannot easily fold into the box 100 without bending. In such cases, an additional fold line 225 across some of the inner side panels 206*a,b,c,d* can allow for easier assembly. For example and without limitation, in the current aspect the inner side panels 206*b,d* without tabs 207 can define the fold lines 225.

Each of the four outer side panels 202*a,b,c,d* can be covered by an insulator pad or batt 226. The insulator pads 226 can comprise paper or other paper fiber materials; however, in other aspects, the insulation batts 226 can comprise cotton, foam, rubber, plastics, fiberglass, mineral wool, or any other flexible insulation material. In the present application, the insulation batts 226 can be repulpable. In the present aspect, the box can be 100% recyclable. In the present aspect, the box 100 can be single-stream recyclable wherein all materials comprised by the box can be recycled by a single processing train without requiring separation of any materials or components of the box 100. In the present aspect, the box 100 can be compostable. In the present aspect, the box 100 can be repulpable. In the present aspect, the box 100 and the insulator pads 226 can be repulpable in accordance with the requirements of the Aug. 16, 2013, revision of the "Voluntary Standard For Repulping and Recycling Corrugated Fiberboard Treated to Improve Its Performance in the Presence of Water and Water Vapor" provided by the Fibre Box Association of Elk Grove Village, IL which is hereby incorporated in its entirety. In the present aspect, the box 100 and the insulator pads 226 can be recyclable in accordance with the requirements of the Aug. 16, 2013, revision of the "Voluntary Standard For Repulping and Recycling Corrugated Fiberboard Treated to Improve Its Performance in the Presence of Water and Water Vapor" provided by the Fibre Box Association of Elk Grove Village, IL.

Recyclable and repulpable insulation materials are further described in U.S. patent application Ser. No. 15/677,738, filed Aug. 15, 2017, U.S. Provisional Patent Application No. 62/375,555, filed Aug. 16, 2016, U.S. Provisional Patent Application No. 62/419,894, filed Nov. 9, 2016, and U.S. Provisional Patent Application No. 62/437,365, filed Dec. 21, 2016, which are each incorporated by reference in their entirety herein.

The insulator pads 226 can be configured or spaced to allow bending of the fold lines 204 between each of the outer side panels 202*a,b,c,d* such that the insulator pads 226 face the interior 110 of the box 100. A first and a third inner bottom panel 218*a,c* can also be covered by insulator pads 226. The insulator pads 226 can be affixed to the panels by glue, hot melt, double-sided tape, or any other method known in the art. In other aspects (not shown), insulator pads 226 can be omitted altogether. In such case, the insulation cavities 104 can use air as an insulating material.

In other aspects (not shown), the number of outer side panels 202*a,b,c,d* (and corresponding panels) can be greater or less than four. In yet other aspects, the tabs 207 need not be on the first and third inner side panels 206*a,c*, and can be on any desired side panel 206.

The insulator pad 226 covering a fourth outer side panel 202*d* can be cut short, and the insulator pad 226 covering a first outer side panel 202*a* can extend past its edge, such that when the first and fourth outer side panels 202*a,d* are joined together—assembling the box in a 3-D configuration—the insulator pad 226 extending from the first outer side panel 202*a* can touch and can cover a portion of the fourth outer side panel 202*d*. In some aspects, the first outer side panel 202*a* can comprise a tab (not shown) that extends outward similar to the tab 207 of the first inner side panel 206*a* and the insulator pad 226 can cover the tab of the first outer side panel 202*a*. In these aspects, the tab beneath the insulator pad 226 covering the first outer side panel 202*a* can contact and can cover a portion of the fourth outer side panel 202*d* instead of the insulator pad 226.

Figure 3:
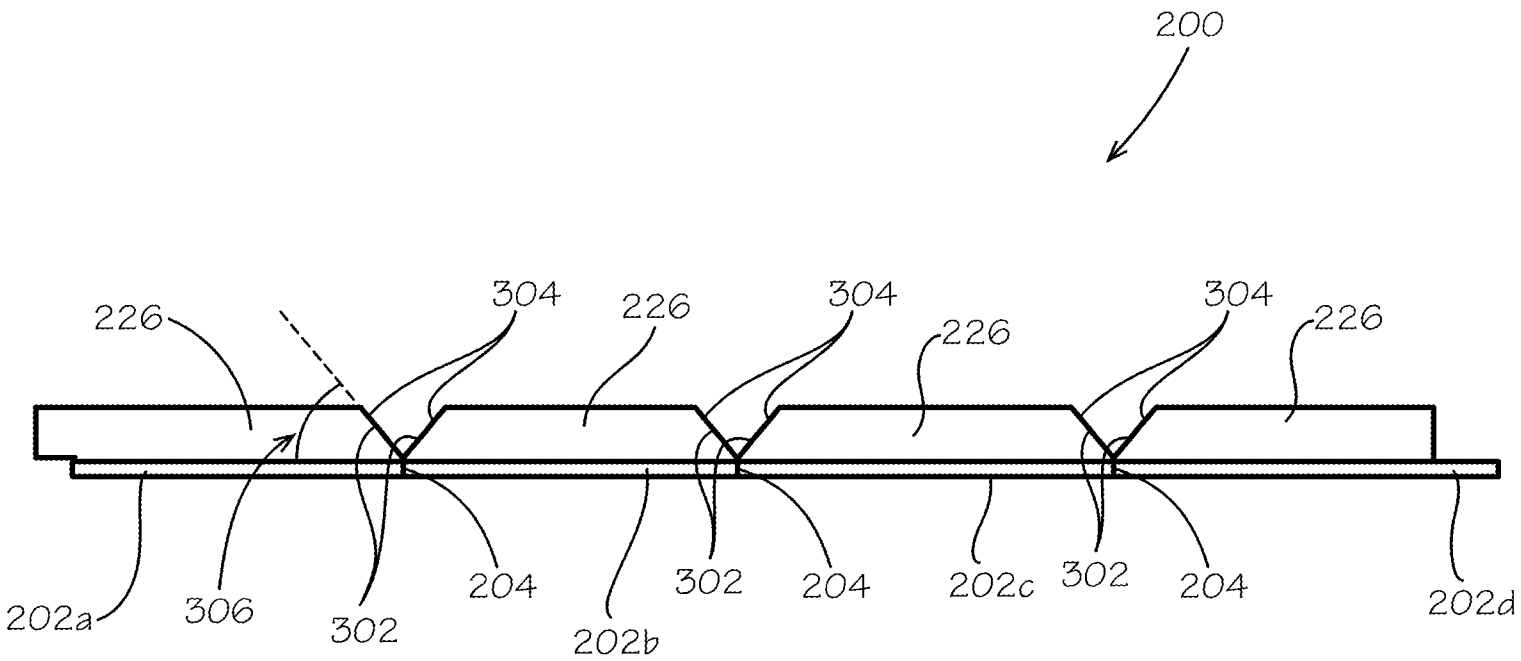
FIG. 3 shows a side view of the blank of FIG. 2.

FIG. 3 shows a side view of the blank 200 of FIG. 2. The insulator pads 226 can be cut along each of their edges 302 at the fold lines 204 between the outer side panels 202*a,b, c,d*. For example, each cut 304 can form an angle 306 with a plane of the blank 200. The angle 306 can be 45-degrees, such that when the box 100 walls 102 each form a 90-degree angle relative to each other, the cuts 304 of the insulator pads 226 are in facing or almost facing contact but are not compressed against each other.

Figure 4:
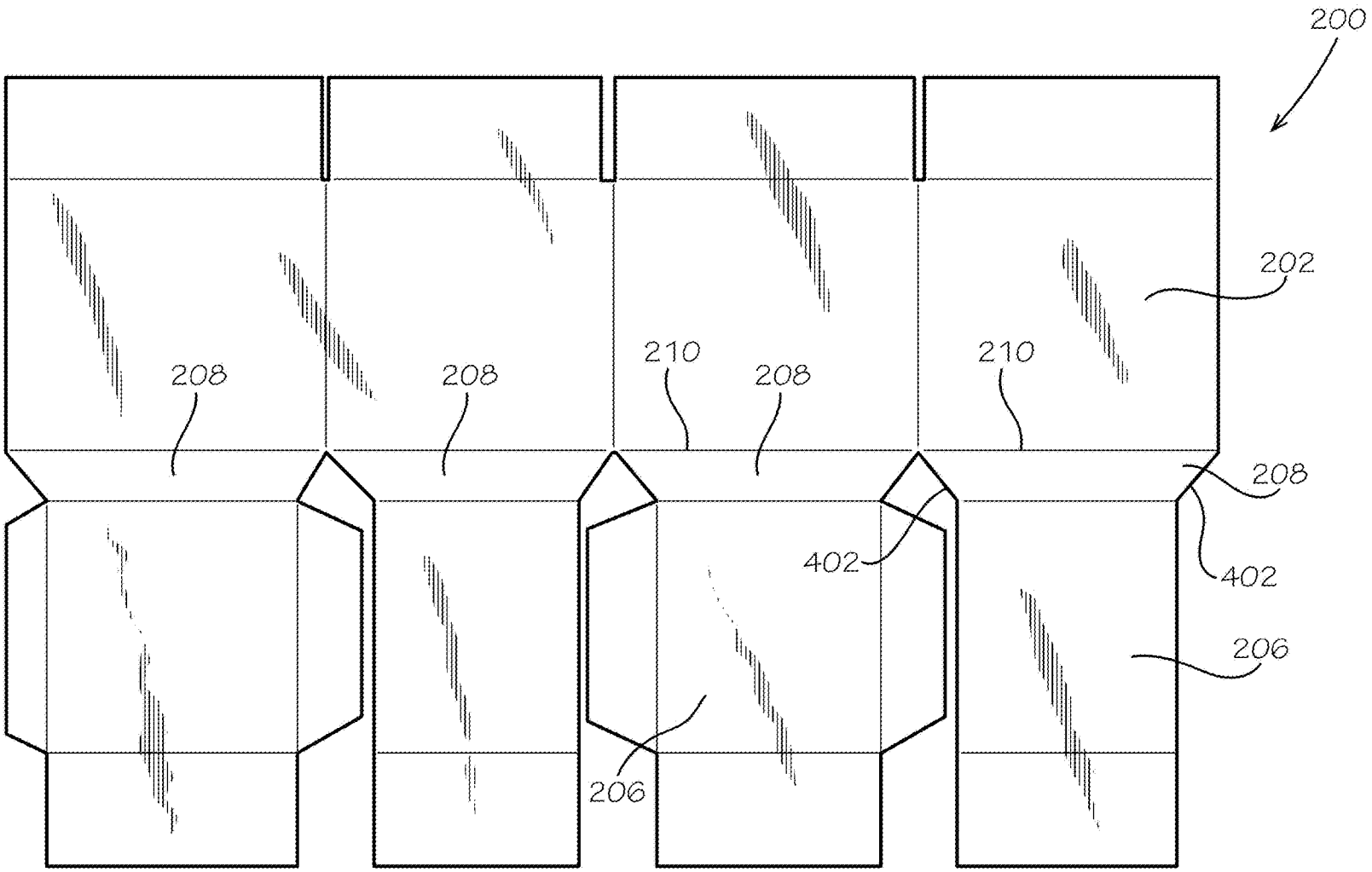
FIG. 4 shows a blank configured to form a box, in accordance with another aspect of the current disclosure.

FIG. 4 shows another aspect of the blank 200 for the box 100 in accordance with the current disclosure. In the current aspect, the insulator pads 226 are omitted. The insulator pads 226 can be inserted during assembly of the box 100 or omitted. The connecting strips 208 can each comprise sides 402 which are angled towards each other in the direction of the inner side panels 206 from the outer side panels 202. For example, the sides 402 of the connecting strips 208 can form approximately a 45-degree angle with the fold line 210 between the connecting strip 208 and the outer side panel 202. In this way, the connecting strips 208 can form a top surface 602 (shown in FIG. 6) of the box 100, each side 402 of the connecting strips 208 in facing or almost facing contact with, without overlapping, one of the sides 402 of the adjacent connecting strips 208.

Figure 5A:
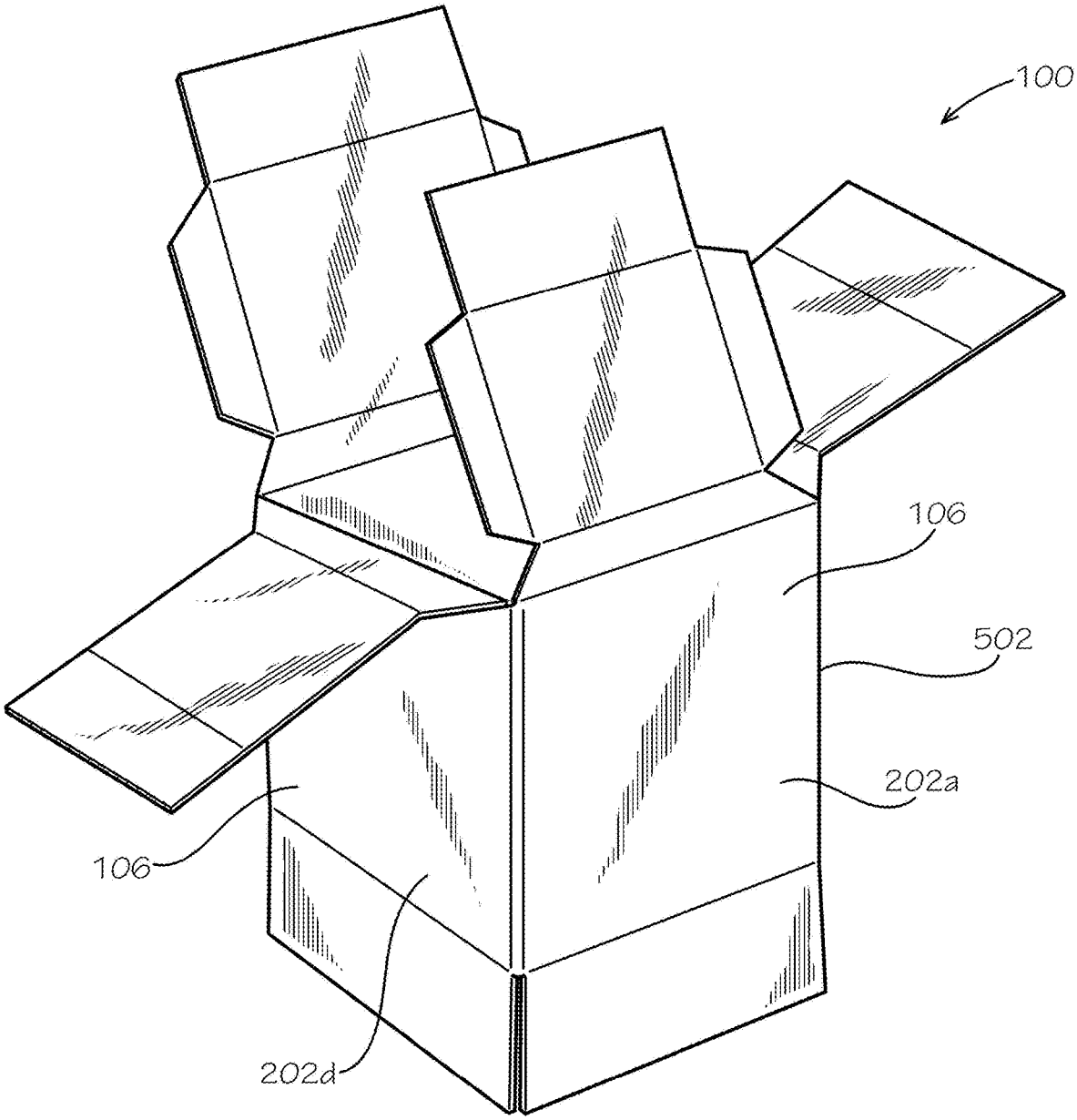
FIG. 5A shows the box corresponding to the blank of FIG. 4, in a partially assembled configuration.

FIG. 5A shows the box 100 corresponding to the blank of FIG. 4, in a partially assembled configuration. The first and the fourth outer side panels 202*a,d* are joined to form a ring 502 comprising the four sides 106 of the box 100.

Figure 5B:
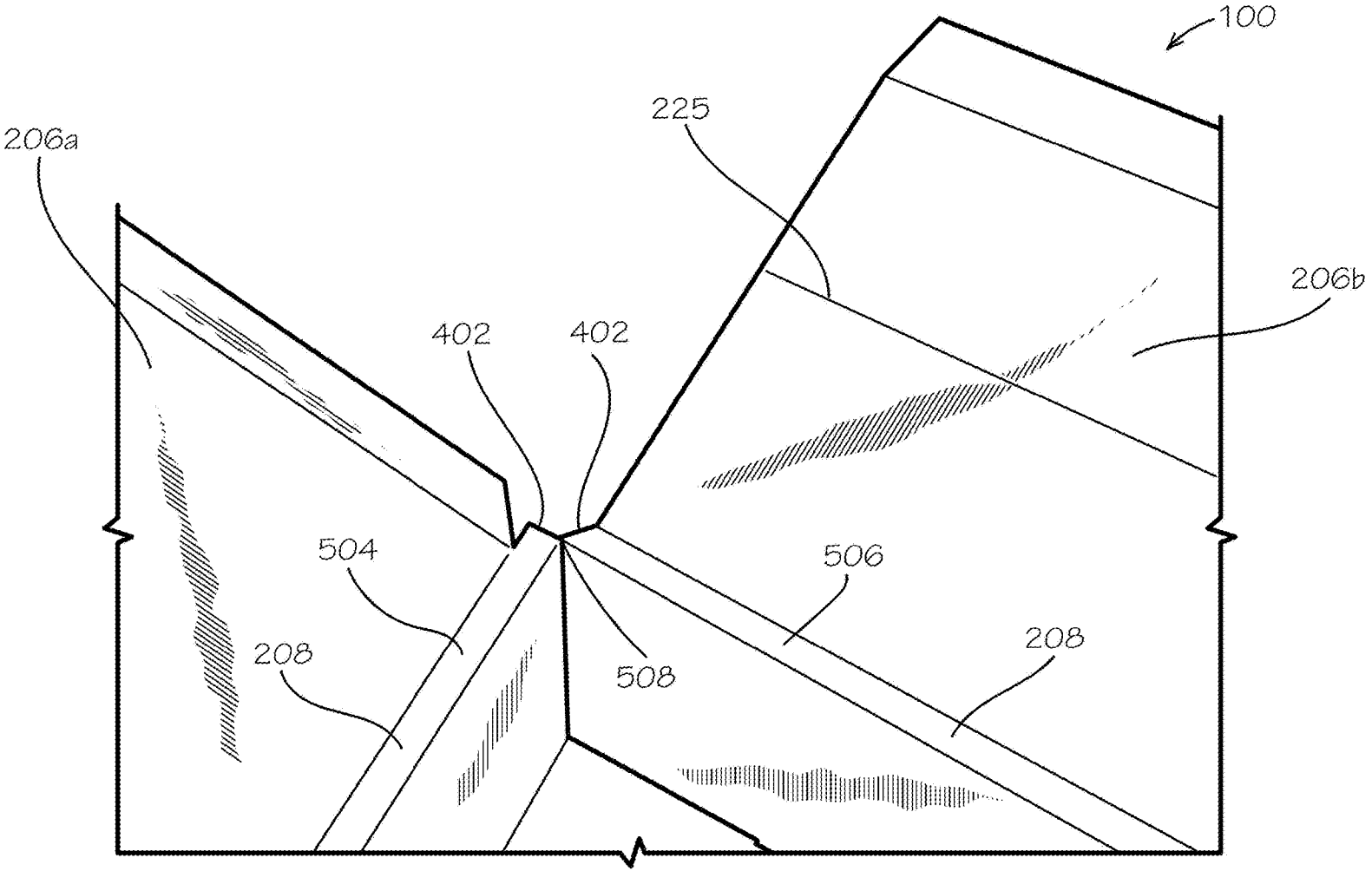
FIG. 5B is a detail view of the box, in accordance with another aspect of the current disclosure.

FIG. 5B is a detail view of the box 100, in accordance with another aspect of the current disclosure. In the present aspect, the box 100 can be assembled from a blank in which the connecting strips 208 can alternate between a rectangular shape 504 (the sides 402 of the connecting strips 208 perpendicular to the fold line 210 between the connecting strip 208 and the outer side panel 202) and a trapezoidal shape 506 (as shown in FIG. 4). The two opposing inner side panels 206*a,c* connected to the rectangular connecting strips 504 can fold into the box 100 first, followed by the opposing inner side panels 206*b,d* connected to the trapezoidal connecting strips 506. In other aspects, different inner side panels 206*a,b,c,d* can have or be attached to the rectangular 504 or trapezoidal connecting strips 506. As such, the angled sides 402 of the trapezoidal connecting strips 506 can provide a symmetric look to the corners 508 of the box, while the sides 402 of the rectangular connecting strips 504 can be tucked under the trapezoidal connecting strips 506, such that no gap is defined therebetween to see inside the insulation cavities 104. In the current aspect, inner side panel 206*b* can have the fold line 225. In other aspects, fold lines 225 can be present on one or more of the other inner side panels 206*a,b,c,d*.

Figure 6:
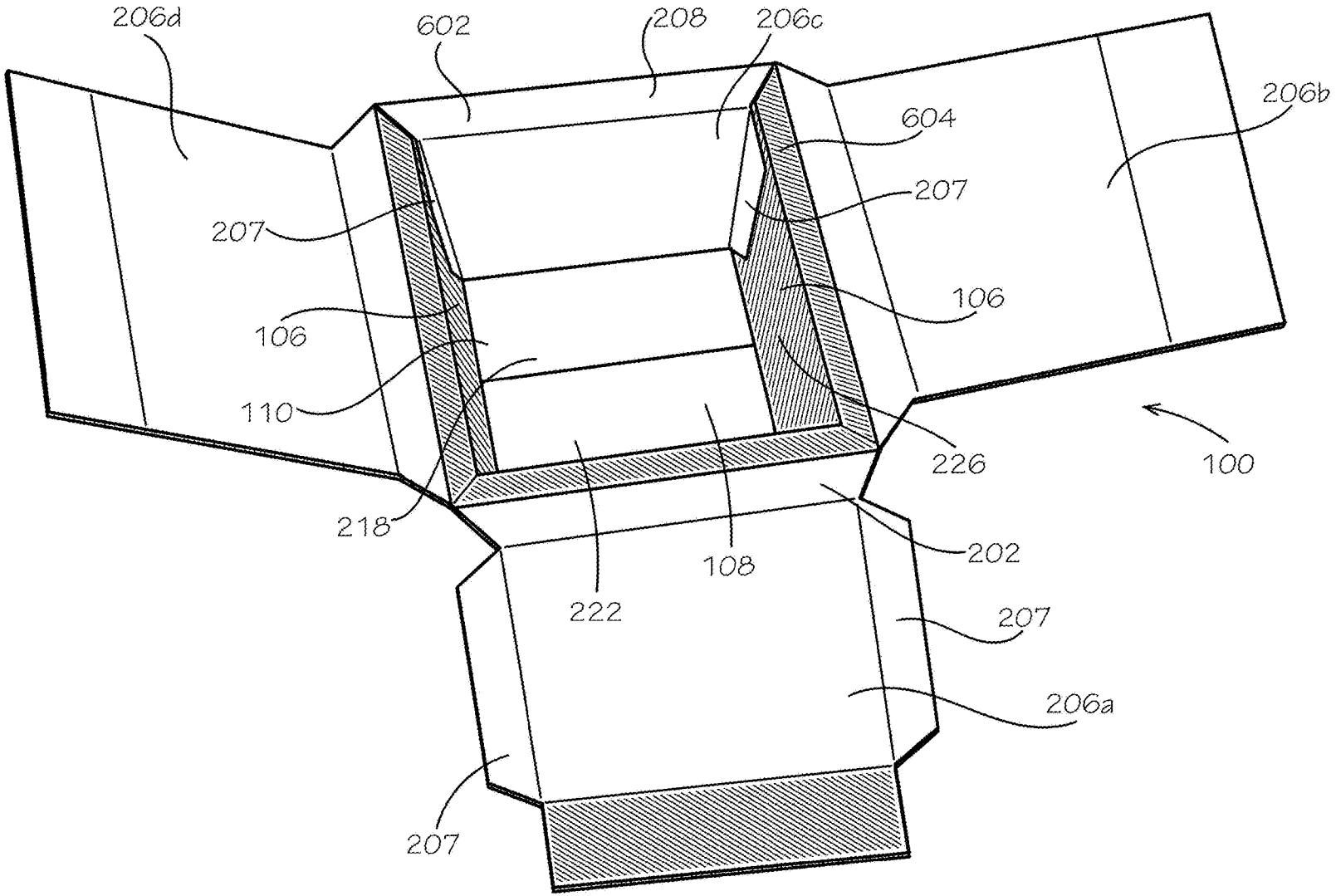
FIG. 6 shows the box comprising insulator pads, wherein an inner side panel is folded into the box.

FIG. 6 shows the box 100 having the insulator pads 226 (shaded), wherein one of the inner side panels 206 has been folded into the box 100. The connecting strip 208 can cover a top edge 604 of the insulator pad 226. Each inner side panel 206*a,b,c,d* can face the corresponding outer side panel 202*a,b,c,d* (not shown in FIG. 6) and sandwich a respective one of the insulator pads 226 in each cavity 104 formed therebetween. The tabs 207 can fold to face the adjacent sides 106 of the box 100. The inner bottom panel 218 can form the bottom 108 of the interior 110 of the box 100. Another one of the insulating pads 226 (not shown) can be sandwiched between the inner bottom panel 218 and the outer bottom panels 222.

Figure 7:
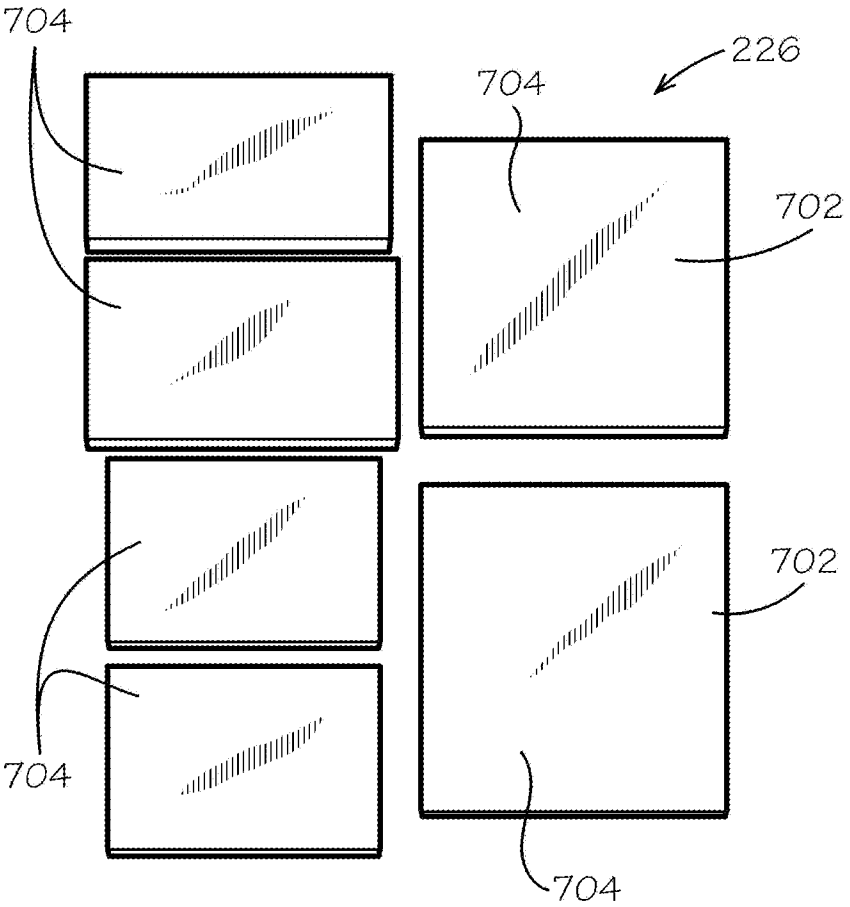
FIG. 7 shows a plurality of insulator pads, in accordance with another aspect of the current disclosure.

FIG. 7 shows another aspect of the insulator pads 226. In the present aspect, the insulator pads 226 can be individual pieces, unattached to a blank and inserted into the insulation cavities 104 during the assembly of the box 100. Two bottom insulation pads 702 can insulate the insulation cavity 104 of the bottom 108 of the box 100, which can also be called a bottom insulation cavity. The insulator pads 226 can comprise a covering or liner 704 that can be made of plastic, for example and without limitation, such that moisture is prevented from entering an interior of the insulator pads 226.

Figure 8:
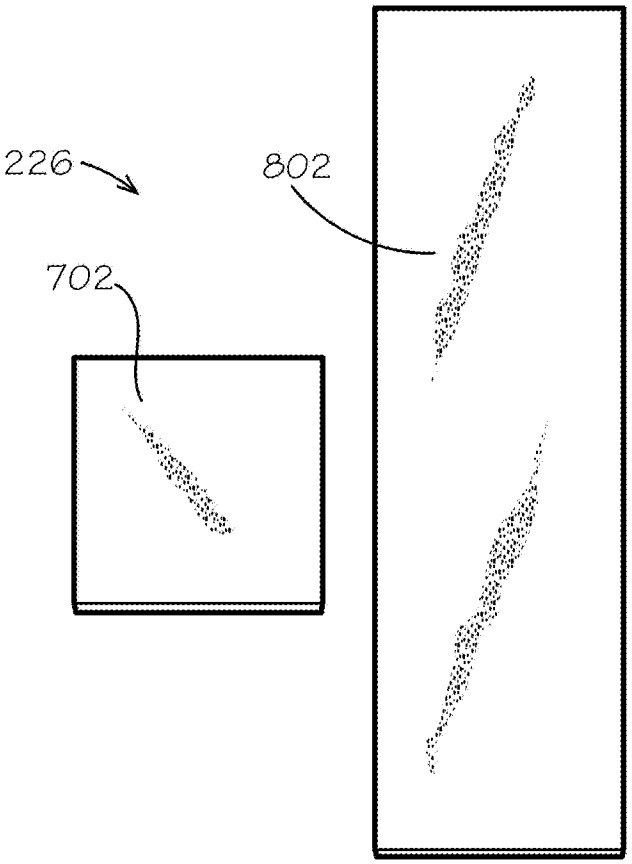
FIG. 8 shows the insulator pads, in accordance with another aspect of the current disclosure.

FIG. 8 shows another aspect of the insulator pads 226. In the present aspect, a singular side insulator pad 802 can fill a plurality of insulation cavities 104 (side insulation cavities) by wrapping circumferentially in the walls 102 of the sides 106 (side walls). A separate bottom insulation pad 702 can insulate the bottom insulation cavity.

The blank 200 of FIG. 2 can be assembled to form the box 100 in its 3-D configuration by a following procedure. The first and the fourth outer side panels 202*a,d* can be joined together such that the insulator pads 226 face the interior 110 of the box 100. The outer bottom panels 222*a,b,c,d* can be folded to form the bottom 108 of the box 100. For example, the first and the third outer bottom panels 222*a,c* can be folded in first, followed by the second and fourth outer bottom panels 222*b,d*. The inner side panels 206*a,b,c,d* can be folded in towards the interior 110 of the box 100, such that the inner side panels 206*a,b,c,d* contact the insulator pads 226, and such that the inner bottom panels 218*a,b,c,d* face and lay over the outer bottom panels 222*a,b,c,d*. In the current aspect, for the blank 200 shown in FIG. 2, the first and the third inner side panels 206*a,c* can be folded in first, such that the tabs 207 of the first and third inner side panels 206*a,c* are sandwiched between the second and fourth outer side panels 202*b,d* and the corresponding second and fourth inner side panels 206*b,d*. In another aspect, the second and fourth side inner panels 202*b,d* can be folded into the box 100 first, and then the first and third inner side panels 206*a,c* subsequently folded in, such that the tabs 207 are exposed to the interior 110 of the box 100 in the assembled configuration. In some aspects, the tabs 207 can then attach to the adjacent inner side panels 202*b, d* by glue, hot melt, or any other adhesive known in the art. This method can use the tabs 207 to hold down the second and fourth inner side panels 202*b,d*, while the previous method can allow the tabs 207 to remain hidden.

Furthermore, in the current aspect, the insulator pads 226 on the first and third inner bottom panels 218*a,c* can touch the outer bottom panels 222*a,b,c,d*. The second and fourth inner bottom panels 218*b,d* can then form the bottom 108 facing the interior 110 of box 100. In other aspects, the order of folding can be different, such that the bottom 108 and the sides 106 of the box still comprise insulation cavities 104.

In other aspects, such as when the number of outer side panels 202*a,b,c,d* (and corresponding panels) vary from four, the procedure can be described more generally by the following steps: joining the outer side panels 202*a,b,c,d* at opposite ends 202*a,d* such that the outer side panels 202*a, b,c,d* form a ring 502; folding the outer bottom panels 222*a,b,c,d* to form the bottom 108 of the box 100, the bottom 108 and the ring 502 of outer side panels 202*a,b,c,d* defining the interior 110 of the box 100; folding the inner side panels 206*a,b,c,d* in towards the interior 110 of the box 100, such that the connecting strips 208 cover the top edges 604 of the insulator pads 226, and such that each inner side panel 206*a,b,c,d* faces the corresponding outer side panel 202*a,b,c,d*; and folding the inner bottom panels 218*a,b,c,d* to face the bottom 108 of the box 100.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of assembling a box from a blank and an insulator pad, the method comprising:

obtaining a blank comprising an outer side panel comprising an outer fold line, a connecting strip joined to the outer side panel by a fold line, and an inner side panel connected to the connecting strip by a fold line and defining a plane and comprising an inner fold line positioned parallel to the outer fold line of the outer side panel;

obtaining an insulator pad comprising an angled cut defining an edge of the insulator pad that is angled relative to the plane of the inner side panel;

folding the inner side panel such that the inner side panel faces the outer side panel; and positioning the insulator pad between the outer side panel and the inner side panel such that the edge of the insulator pad is positioned at the inner fold line;

wherein the insulator pad is coupled to the inner side panel and covers the inner side panel and the angled cut of the insulator pad is at most 45-degrees.

2. The method of claim 1, wherein a cavity is defined by the inner side panel, and the insulator pad is at least partially captured by the outer side panel, the inner side panel, and the connecting strip.

3. The method of claim 1, wherein the connecting strip is positioned perpendicular to the outer side panel and the inner side panel.

4. The method of claim 1, wherein the blank further comprises an outer bottom panel joined to the outer side panel by a fold line.

5. The method of claim 4, further comprising folding the outer bottom panel such that the outer bottom panel is perpendicular to the outer side panel.

6. The method of claim 5, wherein the blank further comprises an inner bottom panel joined to the inner side panel by a fold line.

7. The method of claim 6, further comprising folding the inner bottom panel such that the inner bottom panel is perpendicular to the inner side panel.

8. The method of claim 7, further comprising:

obtaining a bottom insulator pad; and positioning the bottom insulator pad in a cavity defined between the outer bottom panel and the inner bottom panel.

9. The method of claim 1, wherein the connecting strip is a trapezoidal connecting strip and defines a trapezoidal side, the trapezoidal connecting strip extends over the edge of the insulator pad.

10. The method of claim 1, wherein the connecting strip defines a top surface and a bottom surface of the box, and the connecting strip extends in facing contact with a portion of the insulator pad coupled to the inner side panel.

11. The method of claim 1, wherein the connecting strip and the insulator pad define a 45-degree angled cut within an insulator liner, and the angled cut within the insulator liner is in facing contact with the insulator pad.

12. The method of claim 1, wherein the blank and the insulator pad are repulpable.

13. A method of assembling a box, the method comprising:

obtaining a blank comprising an outer side panel comprising an outer fold line, an outer bottom panel joined to the outer side panel by a fold line, a connecting strip joined to the outer side panel by a fold line, an inner side panel connected to the connecting strip by a fold line and defining a plane and comprising an inner fold line positioned parallel to the outer fold line of the outer side panel, and an inner bottom panel joined to the inner side panel by a fold line;

obtaining a first insulator pad;

folding the outer bottom panel such that the outer bottom panel is perpendicular to the outer side panel;

folding the inner bottom panel such that the inner bottom panel faces the outer bottom panel;

positioning the first insulator pad between the outer bottom panel and the inner bottom panel;

obtaining a second insulator pad, the second insulator pad comprising an angled cut defining an edge of the second insulator pad that is angled relative to the plane of the inner side panel;

folding the inner side panel such that the inner side panel faces the outer side panel; and positioning the second insulator pad between the outer side panel and the inner side panel such that the edge of the second insulator pad is positioned at the inner fold line;

wherein the second insulator pad is coupled to the inner side panel and covers the inner side panel and the angled cut of the second insulator pad is at most 45-degrees.

14. The method of claim 13, wherein the connecting strip is positioned perpendicular to the outer side panel and the inner side panel.

15. The method of claim 13, wherein the connecting strip is a trapezoidal connecting strip and defines a trapezoidal side, the trapezoidal connecting strip extends over the edge of the second insulator pad.

16. The method of claim 13, wherein the connecting strip defines a top surface and a bottom surface of the box, and the connecting strip extends in facing contact with a portion of the second insulator pad coupled to the inner side panel.

17. The method of claim 13, wherein the connecting strip and the second insulator pad define a 45-degree angled cut within an insulator liner, and the angled cut within the insulator liner is in facing contact with the second insulator pad.

18. The method of claim 13, wherein the blank, the first insulator pad, and the second insulator pad are repulpable.

* * * * *